US009689204B2

(12) United States Patent
Aoi et al.

(10) Patent No.: US 9,689,204 B2
(45) Date of Patent: Jun. 27, 2017

(54) STEPLADDER

(71) Applicants: Tokuo Aoi, Kakamigahara (JP); Tazuko Aoi, Kakamigahara (JP)

(72) Inventors: Tokuo Aoi, Kakamigahara (JP); Tazuko Aoi, Kakamigahara (JP)

( * ) Notice: Subject to any disclaimer, the term of this patent is extended or adjusted under 35 U.S.C. 154(b) by 0 days.

(21) Appl. No.: 14/424,113

(22) PCT Filed: Jan. 29, 2014

(86) PCT No.: PCT/JP2014/051998

§ 371 (c)(1),
(2) Date: Feb. 26, 2015

(87) PCT Pub. No.: WO2014/132733

PCT Pub. Date: Sep. 4, 2014

(65) Prior Publication Data

US 2015/0345219 A1 Dec. 3, 2015

(30) Foreign Application Priority Data

Feb. 26, 2013 (JP) ..... 2013-035545

(51) Int. Cl.
*E06C 1/18* (2006.01)
*E06C 1/20* (2006.01)
(Continued)

(52) U.S. Cl.
CPC ..... *E06C 1/20* (2013.01); *E06C 1/18* (2013.01); *E06C 1/22* (2013.01); *E06C 7/44* (2013.01)

(58) Field of Classification Search
CPC ..... E06C 1/00; E06C 1/18; E06C 1/02; E06C 1/04; E06C 1/06; E06C 1/08; E06C 1/10;
(Continued)

(56) References Cited

U.S. PATENT DOCUMENTS 128,073 A * 6/1872 Roseborough ..... B65F 1/1415 248/100
767,257 A * 8/1904 Banks ..... E06C 1/20 182/169

(Continued)

FOREIGN PATENT DOCUMENTS

EP 1079062 A2 2/2001
FR 881547 A 4/1943

(Continued)

OTHER PUBLICATIONS

International Search Report for PCT/JP2014/051998, Mar. 11, 2014.

(Continued)

*Primary Examiner* — Alvin Chin-Shue
*Assistant Examiner* — Shiref Mekhaeil
(74) *Attorney, Agent, or Firm* — Caesar Rivise, PC

(57) ABSTRACT

A stepladder provided with a coupling frame in the shape of an equilateral triangle, a front support, a rear right support, a rear left support, and spread stoppers for stopping the front support, the rear right support, and the rear left support from spreading. The front support is rotationally attached to a front shaft of the coupling frame, the rear right fixing member is rotationally attached to a right shaft, and the rear left fixing member is rotationally attached to a left shaft. The rear left support and the rear right support are detachably mounted to the rear left fixing member and the rear right fixing member, respectively. The supports of the stepladder are coupled by the spread stoppers, whereby the three supports are restricted from being displaced forward, to the right rear, and to the left rear.

3 Claims, 17 Drawing Sheets

(51) Int. Cl.
*E06C 1/22* (2006.01)
*E06C 7/44* (2006.01)

(58) Field of Classification Search
CPC ... E06C 1/12; E06C 1/125; E06C 1/14; E06C 1/16; E06C 1/22; E06C 1/24; E06C 1/26; E06C 1/28; E06C 1/30; E06C 1/382; E06C 1/39; E06C 1/393; E06C 7/00; E06C 7/423; E06C 7/42; E06C 7/426; E06C 7/44; A01M 31/02
See application file for complete search history.

(56) References Cited

U.S. PATENT DOCUMENTS 1,610,596 A * 12/1926 Bird ..... E06C 1/20 182/172
1,641,906 A * 9/1927 Smith ..... E06C 1/20 182/169
1,778,898 A 10/1930 Konigsberg
1,783,616 A * 12/1930 Hachmuth ..... E06C 1/20 182/170
1,789,317 A * 1/1931 McLeish ..... F16M 11/242 248/163.1
2,076,918 A 4/1937 Robison
2,316,679 A * 4/1943 Evans ..... F04B 53/1037 403/349
2,391,466 A * 12/1945 Levin ..... B01L 9/00 126/256
2,478,592 A * 8/1949 Nyberg ..... E06C 1/20 182/125
2,612,335 A 9/1952 Saltzman
2,650,014 A * 8/1953 Harrison ..... E06C 1/20 182/126
2,756,952 A * 7/1956 Gazley ..... B63H 21/305 188/317
2,794,612 A * 6/1957 Clifton ..... F16M 11/28 108/1
2,919,093 A * 12/1959 Mooney ..... F16M 11/16 248/168
3,026,962 A * 3/1962 Kramer ..... E06C 1/125 182/108
3,248,129 A * 4/1966 Brown ..... E21B 17/06 166/240
3,269,486 A * 8/1966 Machen ..... E06C 1/22 182/170
3,313,505 A * 4/1967 Petrie ..... B25H 1/00 211/191
3,472,339 A * 10/1969 Crisogono ..... A01K 97/22 182/116
3,540,549 A * 11/1970 Emmons ..... E06C 1/20 182/169
3,902,817 A 9/1975 Meir
3,967,694 A * 7/1976 Woolfolk, Sr. ..... A01K 97/22 135/901
3,998,560 A 12/1976 Damour
4,146,010 A 3/1979 Manska
4,326,687 A * 4/1982 Clyburn ..... F16M 11/16 16/225
4,417,638 A 11/1983 Harvey
4,518,162 A 5/1985 Oates
4,524,849 A * 6/1985 Riddle ..... E06C 1/20 182/170
4,726,349 A * 2/1988 Gehrke ..... A47J 37/0763 126/145
4,732,138 A * 3/1988 Vos ..... A47J 37/046 126/25 A
4,899,849 A 2/1990 Levi et al.
4,943,182 A 7/1990 Hoblingre
5,186,197 A * 2/1993 Lavine ..... A45B 9/02 135/25.1
5,485,978 A * 1/1996 Hernandez ..... A01M 31/02 182/151
5,520,360 A * 5/1996 Wensman ..... F16M 11/24 248/188.5
5,685,391 A 11/1997 Gundlach
6,053,282 A * 4/2000 Morisak ..... A01M 31/02 182/115
6,126,359 A 10/2000 Dittrich et al.
6,189,529 B1 * 2/2001 Shabazian ..... A47J 33/00 126/26
D452,331 S 12/2001 Bohlman
6,386,320 B1 5/2002 Clavel
6,668,975 B2 * 12/2003 Skipper ..... A01M 31/02 182/100
6,711,993 B2 * 3/2004 Robertson ..... A47J 37/0763 126/25 A
7,063,006 B1 * 6/2006 Spehle ..... F24B 1/205 126/25 A
7,207,533 B1 * 4/2007 Coleman ..... F16M 11/16 248/188.2
7,513,470 B2 * 4/2009 Lomberk ..... F16M 11/32 108/106
7,581,703 B1 * 9/2009 Coleman ..... F16M 11/34 248/163.2
7,980,781 B2 7/2011 Trice
8,007,196 B2 8/2011 Whitling et al.
8,262,311 B2 9/2012 Trice
8,490,250 B2 7/2013 Lanz
8,695,762 B1 * 4/2014 Carter ..... A01M 31/02 182/115
9,033,105 B1 * 5/2015 Boswell ..... A01M 31/025 182/115
9,151,112 B2 * 10/2015 Niemela ..... E06C 1/04
2007/0036640 A1 * 2/2007 Boudreaux ..... B65D 88/54 414/800
2007/0256892 A1 * 11/2007 Breedlove ..... A01M 31/02 182/116
2008/0223658 A1 * 9/2008 Michalec ..... A01M 31/02 182/116
2009/0242065 A1 10/2009 Whitling et al.
2011/0088969 A1 * 4/2011 Payne ..... E04G 21/3261 182/8
2011/0155886 A1 * 6/2011 Nakaniwa ..... F16M 11/36 248/440.1
2012/0144626 A1 6/2012 Lanz
2012/0168253 A1 7/2012 McMurray
2013/0153297 A1 * 6/2013 Abney ..... E21B 7/067 175/45
2015/0107146 A1 * 4/2015 Chaney ..... F41A 23/14 42/94

FOREIGN PATENT DOCUMENTS

JP 62-52700 U 4/1987
JP 7-32198 U 6/1995
JP 3031542 U 9/1996
JP 09-112165 A 4/1997
JP 3111306 U 6/2005
JP 2005-282319 A 10/2005

OTHER PUBLICATIONS

International Preliminary Report on Patentability for PCT/JP2014/051998 (undated).

* cited by examiner

STEPLADDER

BACKGROUND OF THE INVENTION

The present invention relates to a stepladder capable of reducing the risk of toppling.

Conventionally, stepladders are used in light work at height, for example, pruning of tree branches. A tripod stepladder and a four-legged stepladder are known as such stepladders. For example, a conventional four-legged stepladder 20 shown in FIG. 11 includes a front leg pair 21 and a rear leg pair 22, which are shaped as ladders. The front and rear leg pairs 21 and 22 are coupled to each other. The distance between the ground contact points of left and right legs 21L and 21R of the front leg pair 21 and the distance between the ground contact points of left and right legs 22L and 22R of the rear leg pair 22, or the widths, are fixed. Further, the distance between the ground contact point of the front left leg 21L and the ground contact point of the rear left leg 22L is fixed, and the distance between the ground contact point of the front right leg 21R and the rear right leg 22R is fixed. The taller the type of stepladder, the greater the width of the stepladder becomes.

FIG. 12 shows a conventional four-legged stepladder 23 including a front left leg 21L, a front right leg 21R, a rear left leg 22L, and a rear right leg 22R that have adjustable lengths. Thus, even if there is a slight unevenness in the installation location, the height of each leg can be changed in conformance with the unevenness.

FIG. 13 shows a conventional tripod stepladder 25 that includes a ladder-shaped front leg pair 23 and a bar-shaped rear leg 24. The front leg pair 23 includes a front left leg 23L and a front right leg 23R that are fixed to form a predetermined width. The taller the type of stepladder, the greater the width of the stepladder becomes.

Besides the conventional stepladders shown in FIGS. 11 to 13, stepladders described in Patent Documents 1 to 3 are known.

However, in the conventional four-legged and tripod stepladders, increase in the distance between the front legs and the rear leg(s) or increase in the width between the left and right legs of the front leg enlarges the footprint of the stepladder. Thus, even when the height of a stepladder is increased in accordance with the purpose and type, increase in the width tends to be restrained. As a result, a higher stepladder has a higher risk of lateral toppling.

Moreover, in the conventional four-legged and tripod stepladders, the front and rear legs spread only to the front and rear. Reduction in the angels between the supports of the front and rear legs and the horizontal installation surface does not reduce the risk of lateral toppling. Furthermore, the legs of the ladder that function as the front legs have a large width. This prevents setting of the legs of the ladder in narrow space, such as a place where various items of equipment are already installed and a place with hedges. In addition, since the front and rear legs are fixed, the stepladder cannot be set in a place including facility pipes or tree branches above the ground or in a place having significant slopes or unevenness.

PRIOR ART DOCUMENTS

Patent Documents

Patent Document 1: Japanese Laid-Open Utility Model Publication No. 7-32198

Patent Document 2: Japanese Registered Utility Model No. 3111306

Patent Document 3: Registered Utility Model No. 3031542

SUMMARY OF THE INVENTION

To solve the problems described above, it is an object of the present invention to provide a stepladder that reduces risk of toppling and restrictions of the installation location.

To achieve the foregoing objective and in accordance with a first aspect of the present invention, a stepladder is provided that includes a coupling frame, a front support that is coupled to the coupling frame and includes a ladder, a rear right support coupled to the coupling frame by a rear right fixing member, a rear left support coupled to the coupling frame by a rear left fixing member, and a spread stopper that limits spreading of the front support, the rear right support, and the rear left support. The coupling frame has a shape of a regular triangle. Sides of the coupling frame include a front shaft, a right shaft, and a left shaft. A coupling pipe of the front support is rotationally coupled to the front shaft of the coupling frame. A coupling pipe of the rear right fixing member is rotationally coupled to the right shaft. A pipe of the rear left fixing member is coupled to the left shaft. The rear left support and the rear right support are attached to the rear left fixing member and the rear right fixing member, respectively, in a removal manner. Three supports including the front support, the rear left support, and the rear right support form the stepladder. The spread stopper couples the supports together so that the three supports are arranged to form a regular triangular pyramid and displacement of the three supports in three directions including a front direction, a rear right direction, and a rear left direction is restricted.

Thus, the stepladder can withstand external force applied from any of the front, rear, right and left directions and maintain uniform balance, thereby reducing the risk of lateral toppling.

In accordance with a second aspect of the present invention, a stepladder is provided that includes a coupling frame, a front support that is coupled to the coupling frame and includes a ladder, a rear right support coupled to the coupling frame by a rear right fixing member, a rear left support coupled to the coupling frame by a rear left fixing member, and a spread stopper that limits spreading of the front support, the rear right support, and the rear left support. The coupling frame has a shape of a regular triangle. Sides of the coupling frame include a front shaft, a right shaft, and a left shaft. A coupling pipe of the front support is rotationally coupled to the front shaft of the coupling frame. A coupling pipe of the rear right fixing member is rotationally coupled to the right shaft. A pipe of the rear left fixing member is coupled to the left shaft. The rear left support and the rear right support are attached to the rear left fixing member and the rear right fixing member, respectively, in a removal manner. Three supports including the front support, the rear left support, and the rear right support form the stepladder. The spread stopper couples the supports together so that displacement of the three supports in three directions including a front direction, a rear right direction, and a rear left direction is restricted.

Thus, the stepladder can withstand external force applied from any of the front, rear, right and left directions and maintain uniform balance, thereby reducing the risk of lateral toppling. In addition, such an advantage is achieved with a simple structure.

The above described stepladder preferably includes the following configuration. That is, the rear left fixing member and the rear right fixing member each include a hollow pipe body that opens at a lower end, and a lower portion of the pipe body of each fixing member includes a cut out groove. A distal end section that extends upward from a body section of each support has a reduced outer diameter over a length that is inserted into the pipe body of a corresponding one of the fixing members. A tip section of each support is tapered. The distal end section of each support includes a projection for positioning. Each support includes a step between the distal end section and the body section. The cut out groove of each fixing member has a width that is greater than an outer diameter of the projection. Each cut out groove includes a first linear section that extends upward from a cut end at an inner side of the lower portion of the pipe body of each fixing member and is parallel with an axis of the fixing member, an inclined section extending outward and diagonally downward from an uppermost position of the first linear section, and a second linear section that extends upward and downward from a lowermost position of the inclined section and is parallel with the axis of the fixing member. When each support is inserted and coupled to the pipe body of a corresponding one of the fixing members, the following actions take place. The projection is aligned with the cut end of the cut out groove after the distal end section of the support is inserted, the projection and the support are moved upward along the first linear section of the cut out groove, the projection and the support are moved downward along the inclined section from a position where the upward movement ends, the projection and the support are moved upward along the second linear section from a position where the downward movement ends, and coupling of the support to the fixing member completes when the upward movement ends. When the coupling of each support completes, the lower portion of the pipe body of the fixing member is in contact with the step of the support. A shape of the cut out groove of the lower portion of the pipe body of the rear right fixing member and a shape of the cut out groove of the rear left fixing member are symmetrical.

When the coupling of each support to the corresponding one of the fixing members completes, the lower portion of the pipe body of the fixing member is preferably in contact with the step of the support.

A shape of the cut out groove of the lower portion of the pipe body of the rear right fixing member and a shape of the cut out groove of the rear left fixing member are preferably symmetrical.

A pipe preferably forms the coupling frame.

A chain preferably forms the spread stopper.

A top operation platform is preferably arranged between the coupling frame and the front support, and the top operation platform is preferably rotationally coupled to the coupling frame by a pipe and rotationally coupled to the front support by another pipe.

The present invention provides a stepladder capable of reducing the risk of toppling and restrictions of the installation location.

BRIEF DESCRIPTION OF THE DRAWINGS

FIGS. 10B, 100 and 10D are perspective views showing a coupling sequence of a spread stopper of the stepladder of the second embodiment;

DETAILED DESCRIPTION OF THE PREFERRED EMBODIMENTS

Referring to drawings, embodiments of the present invention will now be described. However, the present invention is not limited to such embodiments.

Figure 1:
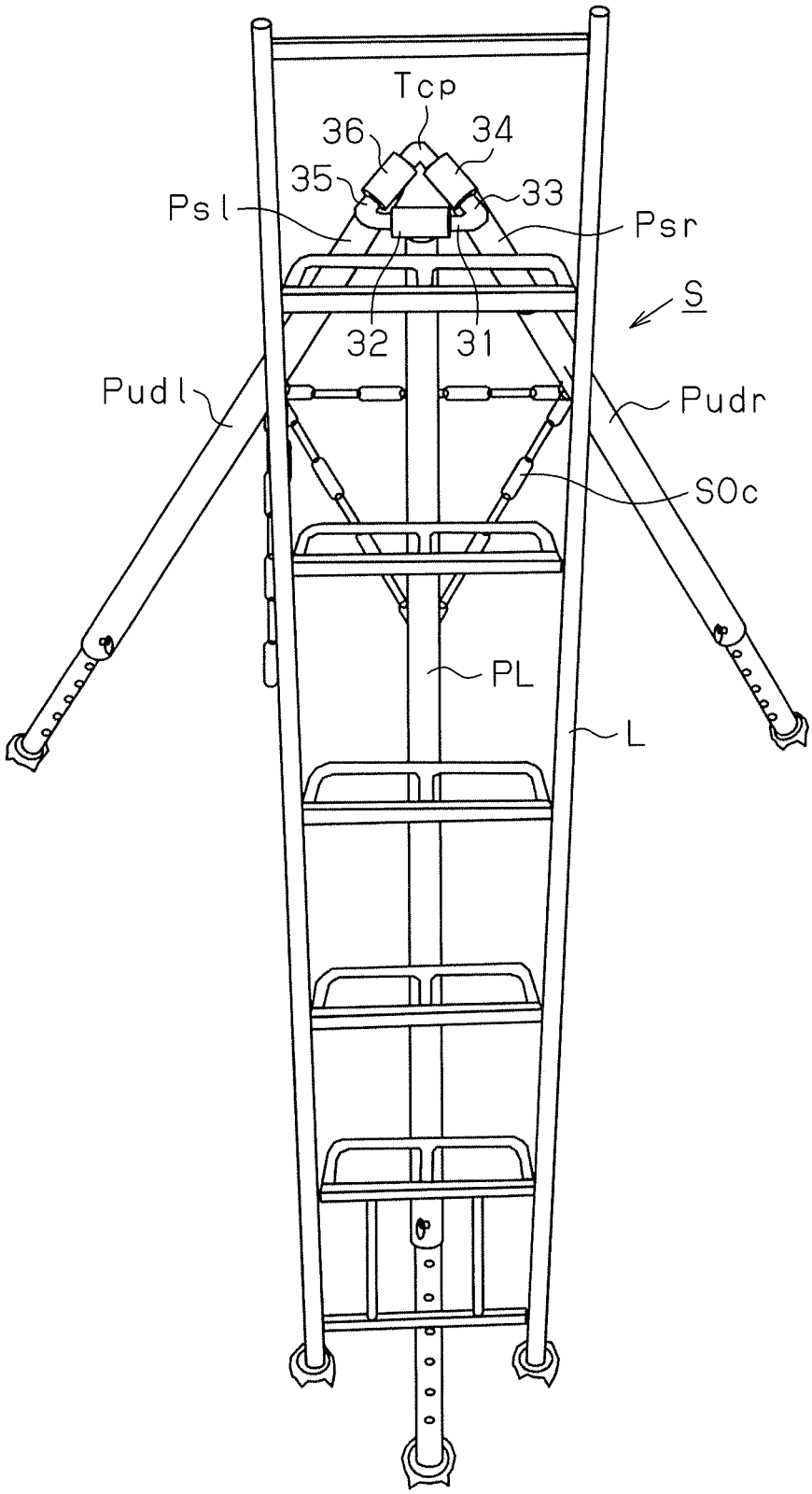
FIG. 1 is an overall perspective view showing a stepladder of a first embodiment of the present invention.

FIG. 1 is an overall perspective view showing a stepladder S of a first embodiment according to the present invention. The stepladder S is a tripod stepladder that includes a coupling frame Tcp, which is a pipe having the shape of a regular triangle, a front support PL including a ladder L, a rear right fixing member Psr for a rear right support, a rear right support Pudr, a rear left fixing member Psl for a rear left support, a rear left support Pudl, and a chain-type spread stopper SOc.

The coupling frame Tcp includes a front shaft 31, a right shaft 33, and a left shaft 35, which are arranged in the three sides of the regular triangle and connected to one another. A coupling pipe 32 of the front support PL is attached to the front shaft 31 of the coupling frame Tcp. A coupling pipe 34 of the rear right fixing member Psr is attached to the right shaft 33. A coupling pipe 36 of the rear left fixing member Psl is attached to the left shaft 35. Accordingly, the three supports PL, Pudr and Pudl are rotationally coupled to the three shafts 31, 33 and 35 of the coupling frame Tcp, respectively. The front shaft 31, the right shaft 33, and the left shaft 35 function as three coupling sections of the coupling frame.

The left support Pudl and the right support Pudr are attached to the left fixing member Psl and the right fixing member Psr, respectively, in a removable manner. The three supports, including the front support PL, form the stepladder S. Each of the supports Pudl, Pudr and PL has an adjustable length.

When the stepladder S is used, the spread stopper SOc connects the front support PL, the rear right support Pudr, and the rear left support Pudl such that each support forms an angle of about 70 degrees with the installation surface. The spread stopper SOc includes two chains. One of the chains is extended from the front support PL, hooked by a hook on the rear right support Pudr, and then hooked by a hook on the rear left support Pudl. The other chain is extended from the front support PL and hooked by a hook on the rear left support Pudl. This fixes the supports. The angle between the three supports and the installation surface is not limited to about 70 degrees. The angle of each support can be set to any angle according to the installation location.

The spread stopper SOc and the coupling frame Tcp couple the three supports Pudl, Pudr and PL to have the shape of a regular triangular pyramid so that displacement in three directions, including the front, rear right, and rear left directions, is restricted. This allows the stepladder to withstand external force applied from any of the front, rear, left, and right direction and maintain uniform balance. Thus, the stepladder maintains the most stable position that resists toppling.

Figure 2:
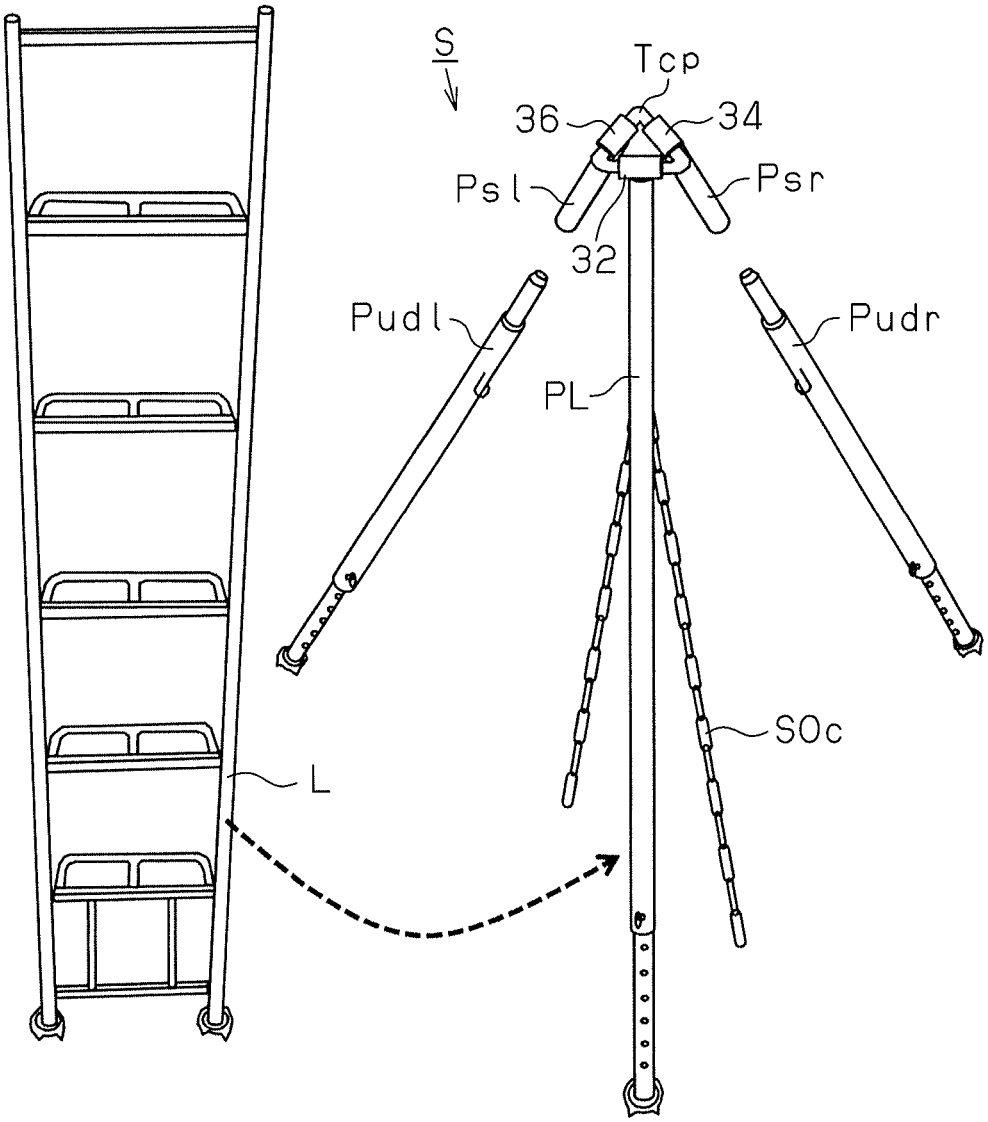
FIG. 2 is an exploded perspective view showing components of the stepladder of the first embodiment.

FIG. 2 is an exploded perspective view showing the components of the stepladder S. The coupling frame Tcp is coupled in advance to the front support PL with ladder. The rear right support Pudr is coupled to the rear right fixing member Psr in a removable manner. The rear left support Pudl is coupled to the rear left fixing member Psl in a removable manner. The spread stopper SOc is coupled to the front support PL in advance. Although the ladder L is shown separated from the front support PL, the front support PL with ladder is an integrated single component.

Figure 3A:
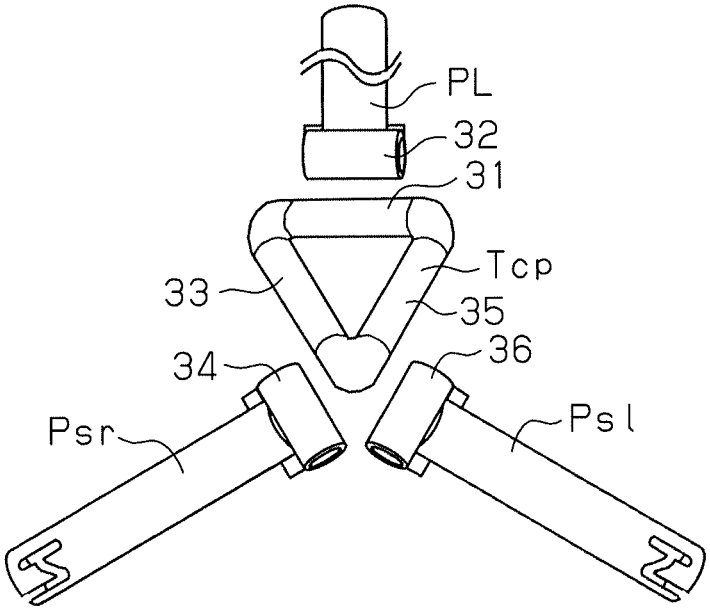
FIG. 3A is an exploded perspective view showing main components of the stepladder of the first embodiment.
Figure 3B:
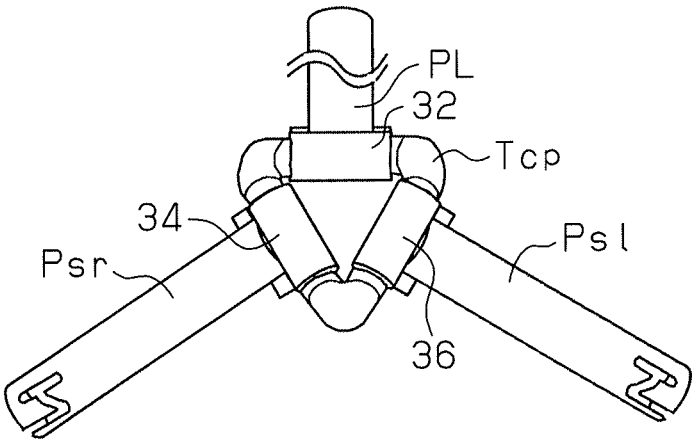
FIG. 3B is a perspective view showing the assembled main components.

FIG. 3A is an exploded perspective view showing the main components of the stepladder S of the first embodiment. FIG. 3B is a perspective view showing the assembled main components. The coupling pipe 32 of the front support PL is coupled to the front shaft 31 of the coupling frame Tcp. The coupling pipe 34 of the rear right fixing member Psr is coupled to the right shaft 33. The coupling pipe 36 of the rear left fixing member Psl is coupled to the left shaft 35. Thus, the three supports are coupled such that each of the supports rotates about the corresponding one of the three sides of the regular triangular coupling frame Tcp that function as shafts of rotation.

Figure 5A:
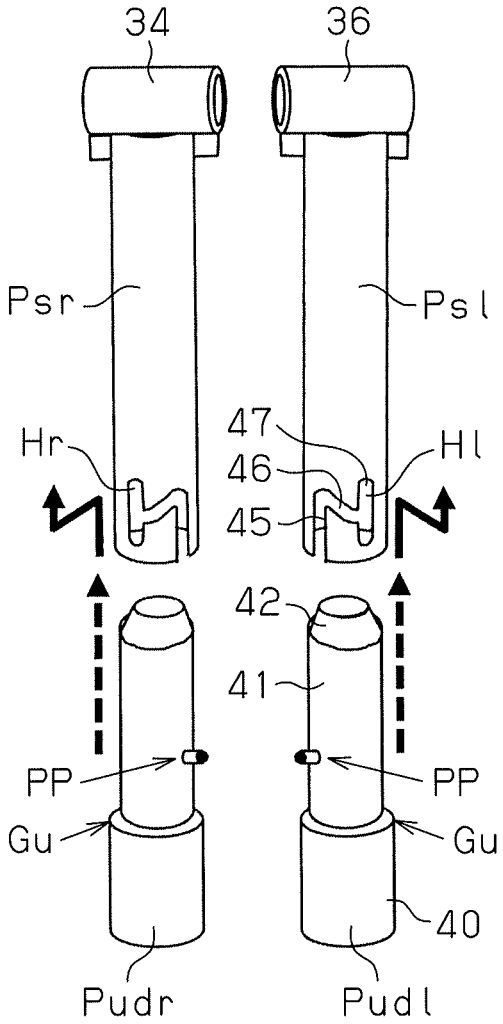
FIGS. 5A, 5B and 5C are perspective views showing supports of the stepladder of the first embodiment in assembled and disassembled states.
Figure 5B:
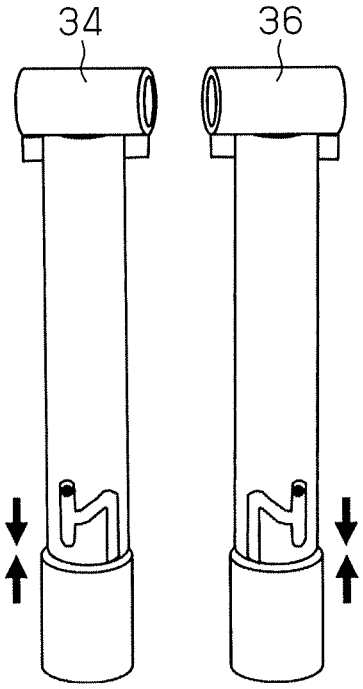
Figure 5C:
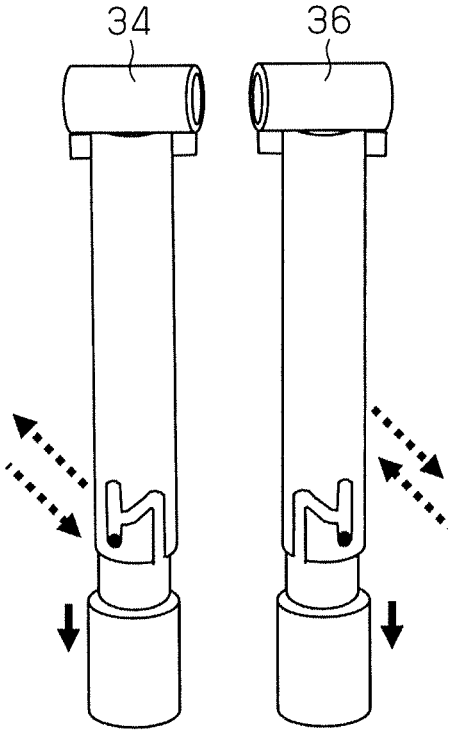

FIGS. 5A, 5B and 5C are perspective views showing disassembled and assembled states of the supports Pudr and Pudl of the stepladder S of the first embodiment. The hooks for the spread stoppers and the feet of the supports Pudr and Pudl need to have predetermined orientations when the supports are coupled. Thus, a mechanism is needed that positions the supports in the same positions in repeated attachment and removal.

In addition, a mechanism is needed that prevents separation of the supports Pudr and Pudl from the fixing members Psr and Psl during use and allows the supports Pudr and Pudl to withstand external force applied to the fixing members Psr and Psl. Furthermore, a mechanism is needed that prevents separation of the supports Pudr and Pudl from the fixing members Psr and Psl when carrying the folded stepladder S in an upright position. The required three mechanisms are achieved by the shapes of cut out grooves Hr and Hl of the fixing members Psr and Psl, positioning projections PP of the supports Pudr and Pudl, and steps Gu of the supports.

FIG. 5A is a diagram showing coupling of the supports. The rear left fixing member Psl includes a hollow pipe body having an open lower end. The lower portion of the pipe body of the rear left fixing member Psl includes a cut out groove Hl that resembles letter N. A distal end section 41 extending upward from a body section 40 of the rear left support Pudl has a reduced outer diameter over the length that is inserted into the pipe body of the rear left fixing member Psl. A tip section 42 is tapered to facilitate the insertion. The distal end section 41 of the rear left support Pudl includes a projection PP for positioning. A step Gu is formed at the border between the distal end section 41 and the body section 40 of the rear left support.

The cut out groove Hl of the rear left fixing member has a width slightly greater than the outer diameter of the projection PP for positioning. The cut out groove Hl includes a first linear section 45, an inclined section 46, and a second linear section 47. The first linear section 45 extends parallel to the axis of the rear left fixing member Psl from a cut end at the inner side of the lower portion of the pipe body of the rear left fixing member Psl. The inclined section 46 extends from the upper end of the first linear section 45 diagonally downward to the outer side. The second linear section 47 extends both downward and upward from the lower end of the inclined section 46 in parallel with the axis of the fixing member. The shape of the cut out groove Hr of the lower portion of the pipe body of the rear right fixing member Psr and the shape of the cut out groove Hl of the rear left fixing member Psl are symmetrical.

As indicated by an arrow, in inserting and coupling the rear left support Pudl to the pipe body of the rear left fixing member Psl, the projection PP is aligned with the cut end of the left cut out groove Hl after the distal end section 41 of the rear left support Pudl is slightly inserted, and the projection PP and the support Pudl are then moved upward along the first linear section 45 of the cut out groove Hl. The projection PP and the support Pudl are then moved downward along the inclined section 46 from the position where the upward movement ends. The projection PP and the support Pudl are then moved upward along the second linear section 47 from the position where the downward movement ends. The coupling of the support Pudl to the rear left fixing member Psl completes when the upward movement ends.

In inserting and coupling the rear right support Pudr to the pipe body of the rear right fixing member Psr, the projection PP and the rear right support Pudr are moved along the cut out groove Hr of the rear right fixing member in a symmetrical manner to the movement in which the projection PP of the support Pudl is inserted into the cut out groove Hl of the rear left fixing member.

FIG. 5B is a diagram explaining fixation of the supports. When the projection PP is located at the uppermost position of the second linear section 47 of the cut out groove Hl of the rear left fixing member Psl, the lower portion of the pipe body of the rear left fixing member Psl is in contact with the step Gu of the rear left support Pudl. The rear left support Pudl is not separated from the rear left fixing member Psl. As indicated by arrows, the rear left support Pudl withstands external force applied to the rear left fixing member Psl. Similarly, the rear right support Pudr withstands external force applied to the rear right fixing member Psr.

FIG. 5C is a diagram showing a state in which the supports are suspended and carried. When the stepladder S in which the supports are fixed as shown in FIG. 5B is folded to be carried in an upright position, the two supports Pudr and Pudl, which are laterally spread, need to be pulled inward toward the front support PL located in the center. To prevent separation of the projections PP of the supports Pudr and Pudl from the respective cut out grooves Hr and Hl, each second linear section 47 is arranged at the outer side of the pipe body of the corresponding fixing member Psr or Psl. This allows the each projection PP to move upward and downward in engagement with the inner wall surface of the second linear section 47 of the corresponding cut out groove Hr or Hl. After the supports Pudr and Pudl are pulled toward the front support PL, each projection PP falls by the weight of the support and is engaged with the lower end of the second linear section 47. Thus, the supports are suspended from the respective fixing members Psr and Psl. This allows the stepladder to be carried in this position.

When the stepladder S is used again after being carried, the left and right supports Pudl and Pudr need to be lifted and spread. To prevent separation of the projection PP of each support from the corresponding one of the cut out grooves Hr and Hl in such movements, the wall surface that resists inward movement of the projection PP, which engages the lower end of the second linear section 47, needs to extend to the uppermost section associated with the fixed position of the support shown in FIG. 5B. In addition, each of the cut out grooves Hr and Hl needs to extend to its cut end. Thus, the inclined section 46 extends diagonally upward to the inner side from a middle section of the second linear section 47.

Figure 6:
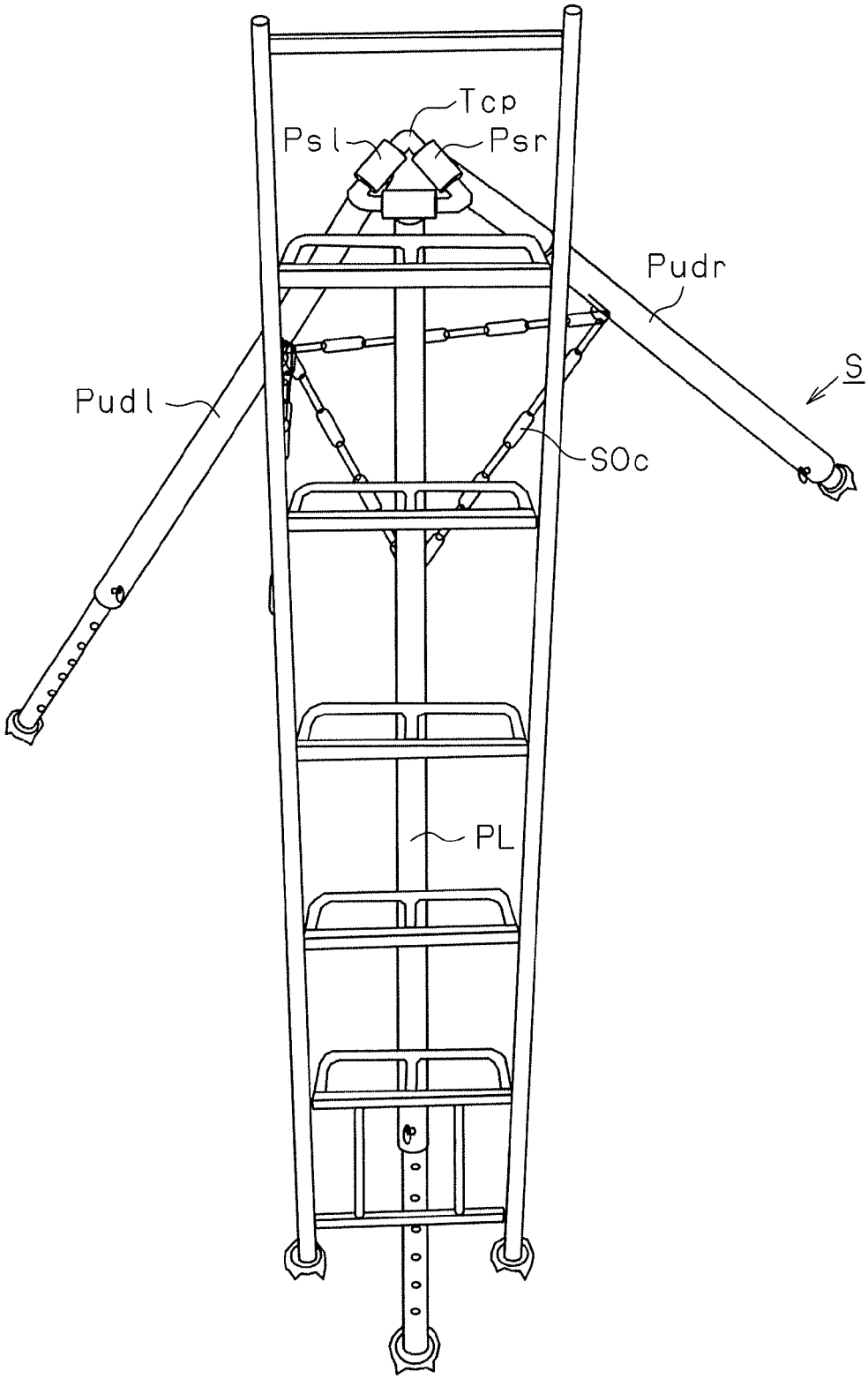
FIG. 6 is a perspective view showing the stepladder of the first embodiment in the first use position.

FIG. 6 is a perspective view showing a use position of the stepladder S of the first embodiment. In accordance with the restrictions of the installation location, the legs of the front support PL and the rear left support Pudl are extended, and the leg of the rear right support Pudr is shortened.

Figure 7:
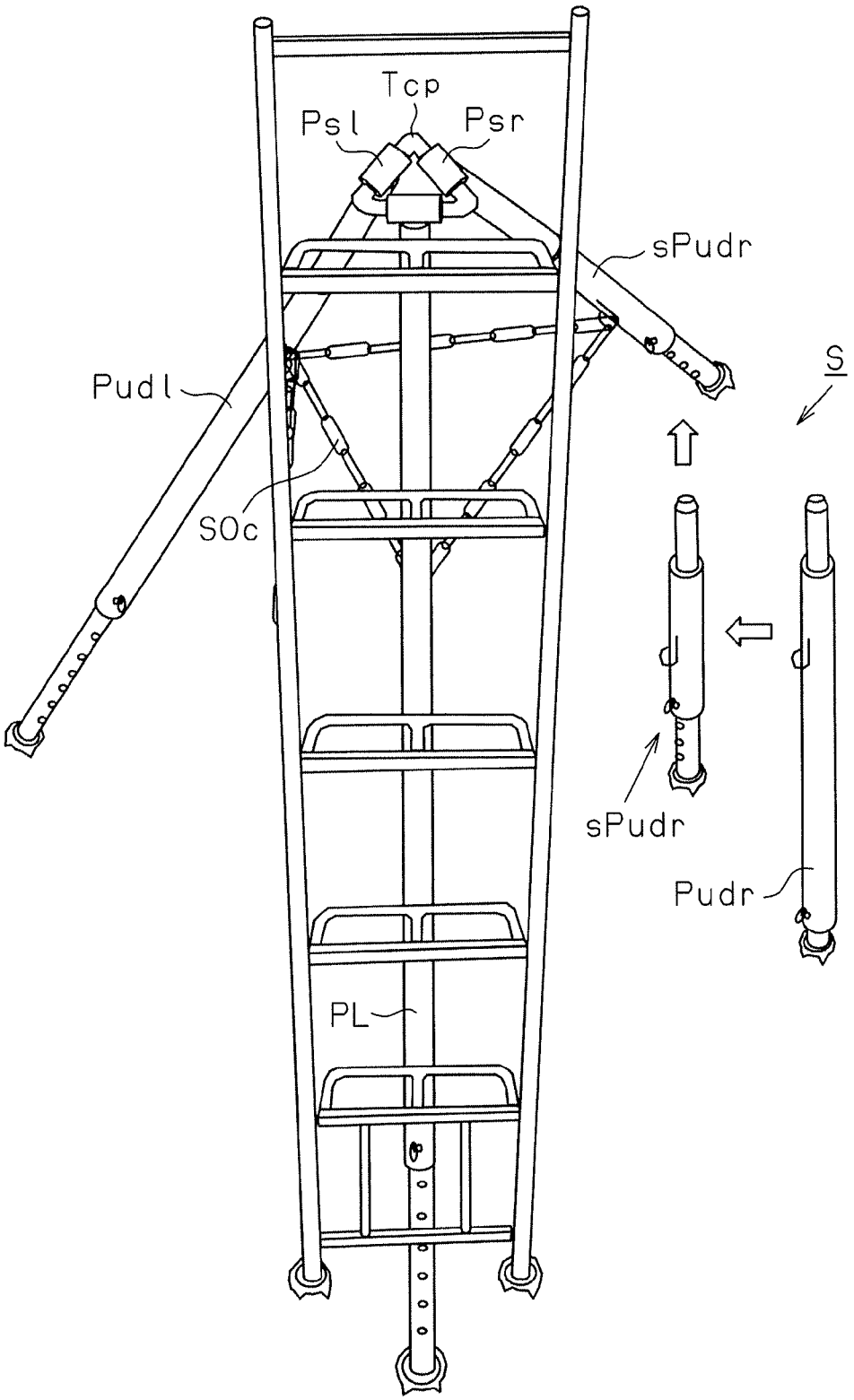
FIG. 7 is a perspective view showing the stepladder of the first embodiment in the second use position.

FIG. 7 is a perspective view showing another use position of the stepladder S of the first embodiment. In accordance with the restrictions of the installation location, the legs of the front support PL and the rear left support Pudl are extended. If the stepladder S cannot be set even after the leg of the rear right support Pudr is shortened, a shorter rear right support sPudr may replace the rear right support Pudr.

Figure 8:
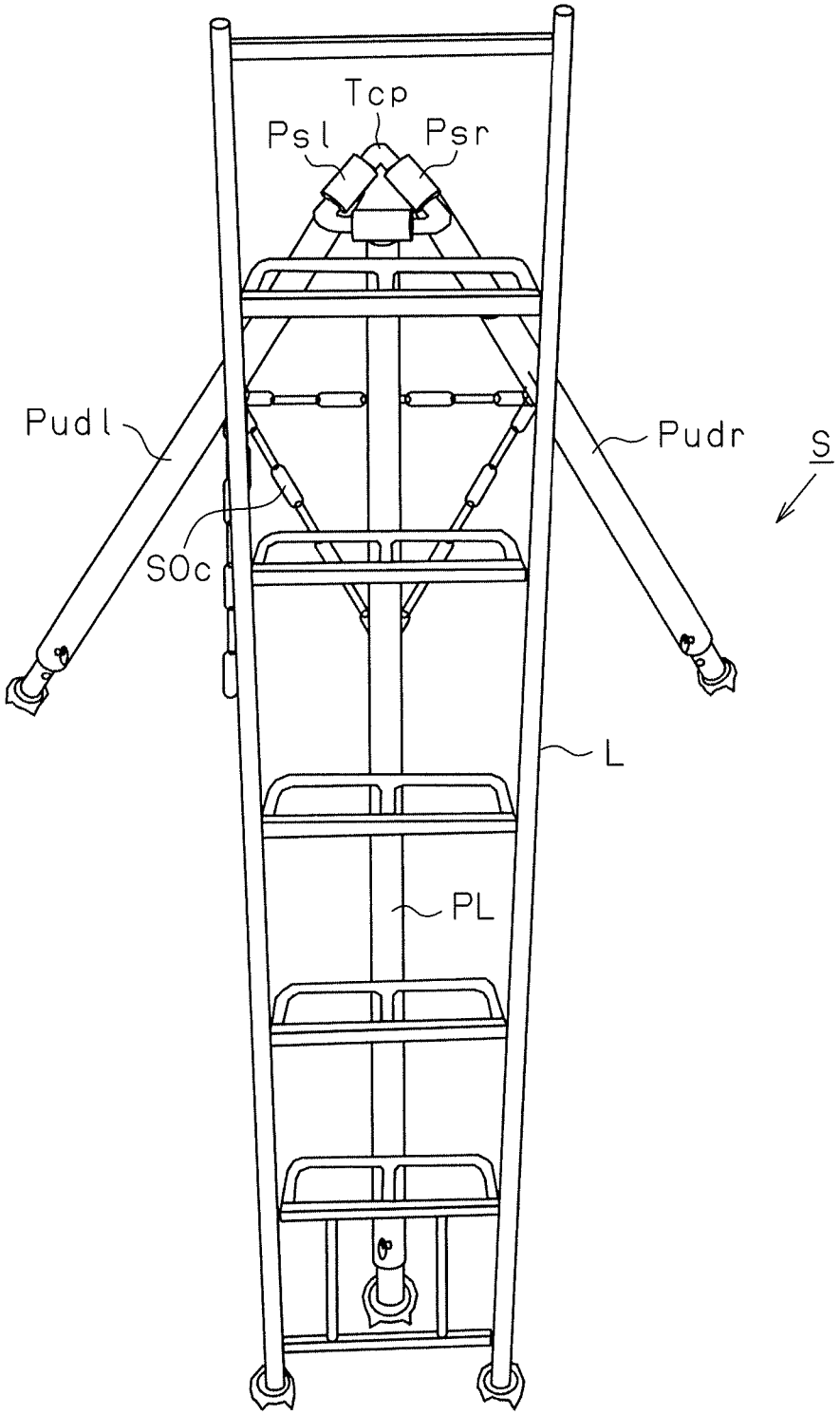
FIG. 8 is a perspective view showing the stepladder of the first embodiment in the third use position.

FIG. 8 is a perspective view showing yet another use position of the stepladder S of the first embodiment. When the installation location is flat and free from restrictions, the legs of the front support PL, the rear left support Pudl, and the rear right support Pudr are shortened. Both legs of the ladder L of the front support PL are on the ground.

Figure 9:
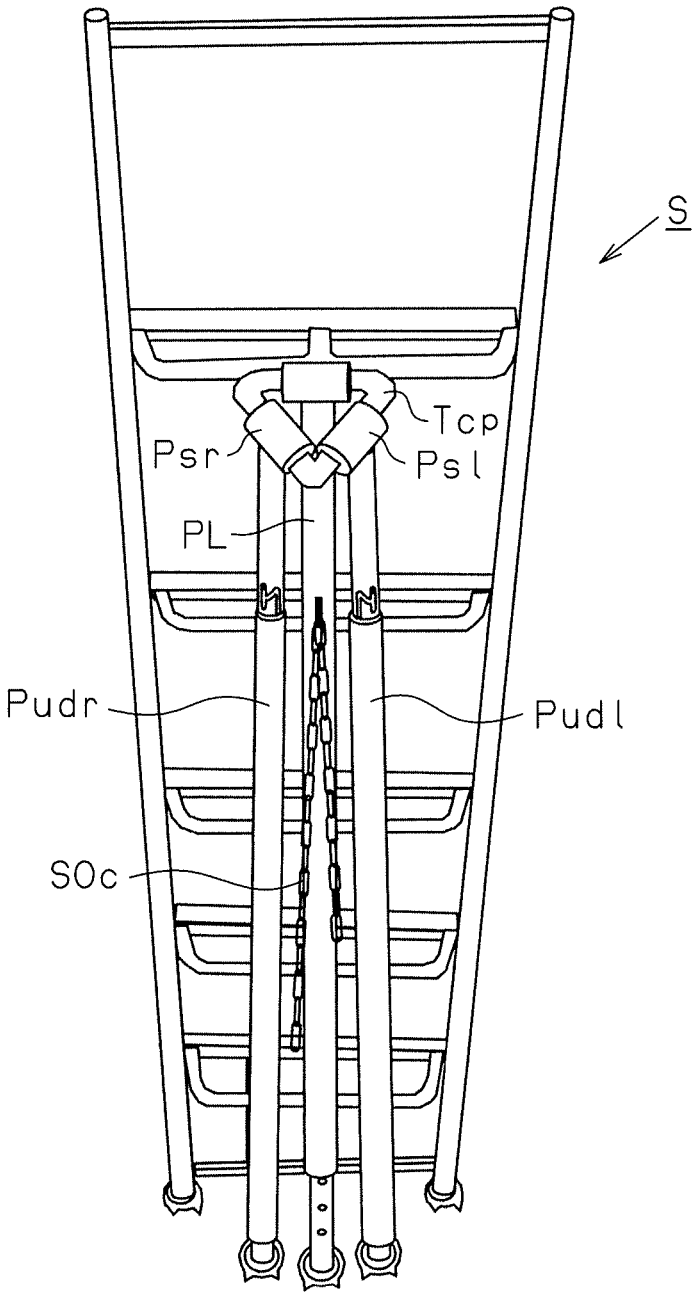
FIG. 9 is a perspective view showing the stepladder of the first embodiment in a folded state.

FIG. 9 is a perspective view showing the folded ladder S of the first embodiment. When the stepladder S is folded to be carried in an upright position, the stepladder S is folded by pulling the rear right support Pudr and the rear left support Pudl, which are laterally spread, inward toward the front support PL having the ladder. This allows for carrying and storing of the stepladder in a compact folded state.

Figure 14:
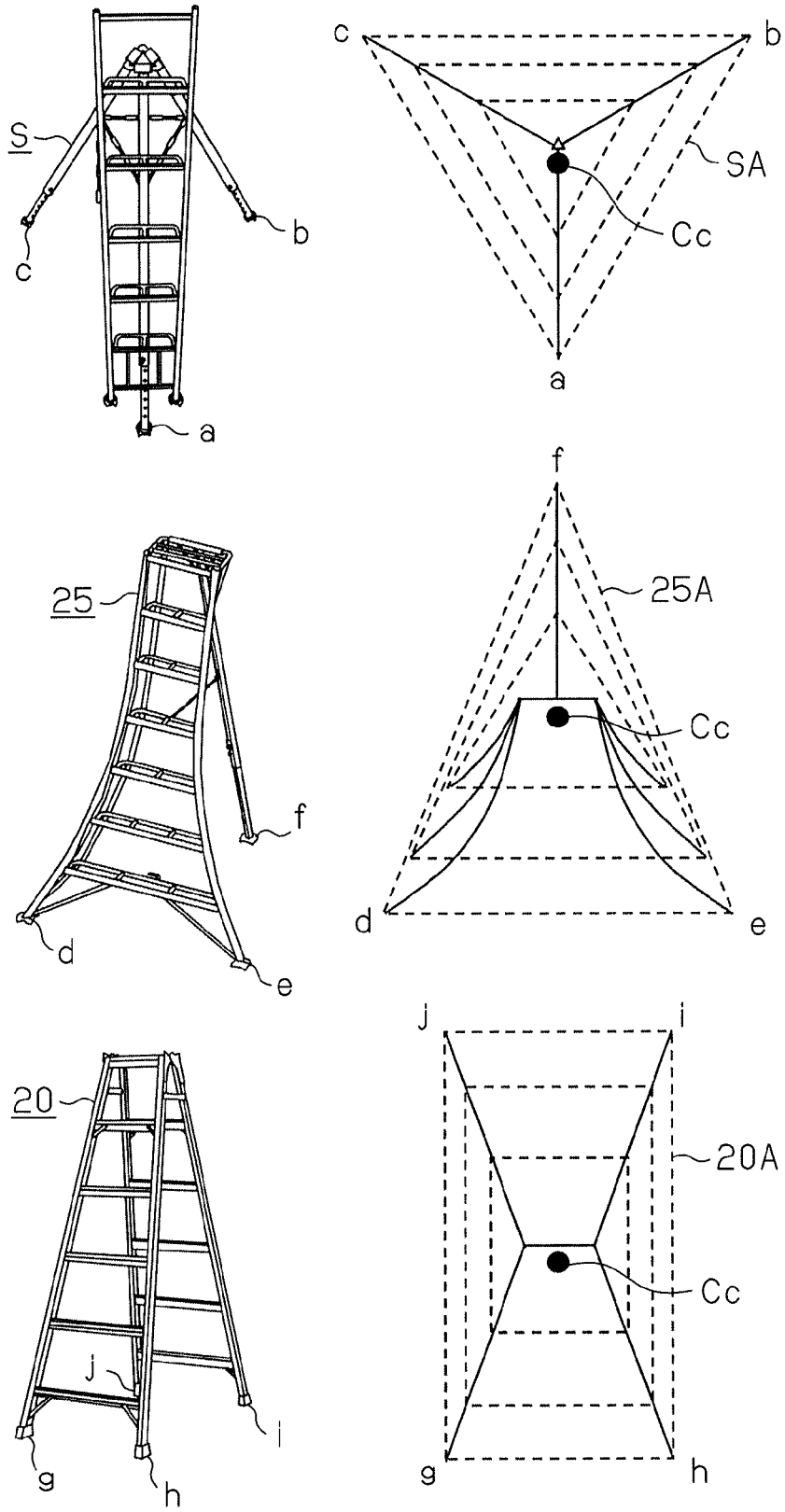
Fig. 14 is a diagram for comparison of the risks of toppling of the stepladder of the first embodiment according to the present invention, the tripod stepladder of the third conventional example, and the four-legged stepladder of the first conventional example.

Referring to FIG. 14, the risks of toppling of the stepladder S of the first embodiment according to the present invention, a tripod stepladder 25 of the third conventional example, and a four-legged stepladder 20 of the first conventional example are compared based on the arrangements of the legs or supports.

Under a condition in which the angles between the horizontal installation surface and the legs or supports of the ladders S, 25 and 20 are set at a certain angle, specifically, 75 degrees, and the length of each support is set to 360 cm, the ground contact positions of the legs are indicated by symbols a to j. The stepladder S does not topple when the center of gravity Cc of the operator on the stepladder S is within a triangular installation area SA that is surrounded by the dotted line connecting the ground contact points a, b and c of the stepladder S of the first embodiment.

The tripod stepladder 25 does not topple when the center of gravity Cc of the operator on the stepladder 25 is within a triangular installation area 25A that is surrounded by the dotted line connecting the ground contact points d, e and f of the stepladder 25. Similarly, the four-legged stepladder 20 does not topple when the center of gravity Cc of the operator who operates on the stepladder 20 is within a rectangular installation area 20A that is surrounded by the dotted line connecting the ground contact points g, h, i and j of the stepladder 20.

When the angle between the horizontal surface and the stepladders S, 20 and 25 is fixed to 75 degrees and the length of each support is successively changed to 270 cm and 150 cm, the sizes of the installation areas SA, 25A and 20A of the stepladders S, 25 and 20 successively decrease as shown in FIG. 14. However, each stepladder does not topple when the center of gravity Cc of the operator on the ladder is within the corresponding one of installation locations SA, 25A and 20A of reduced size.

The comparison among the risks of toppling of the three stepladders is as follows. In the conventional tripod stepladder 25 and the four-legged stepladder 20, even if the height of the stepladder is increased, the increase in the width between the front left leg and the front right leg is restrained. The widths of the ladders are the distance between the ground contact points c and b, the distance between the ground contact points d and e, and the distance between the ground contact points g and h.

In a conventional stepladder, increase in the width is restrained. Thus, increase in the height increases the risk of lateral toppling. In contrast, in the stepladder S of the first embodiment, the distance between adjacent two ground contact points can be increased according to the height. Thus, increase in the height reduces the risk of lateral toppling.

Further, in the tripod stepladder 25 and the four-legged stepladder 20, the front legs and rear legs spread only to front and rear. Thus, even if the angles between the horizontal installation surface and the front and rear leg supports are reduced, the distance between the ground contact points is increased only in the front and rear direction. This does not reduce the risk of lateral toppling. In contrast, in the stepladder S of the first embodiment, reduction in the angles between the legs of the stepladder and the horizontal surface increases the size of the installation area SA shown in FIG. 14. This reduces the risk of lateral toppling.

As is evident in the foregoing descriptions, the present invention has the following advantages.

Figure 15:
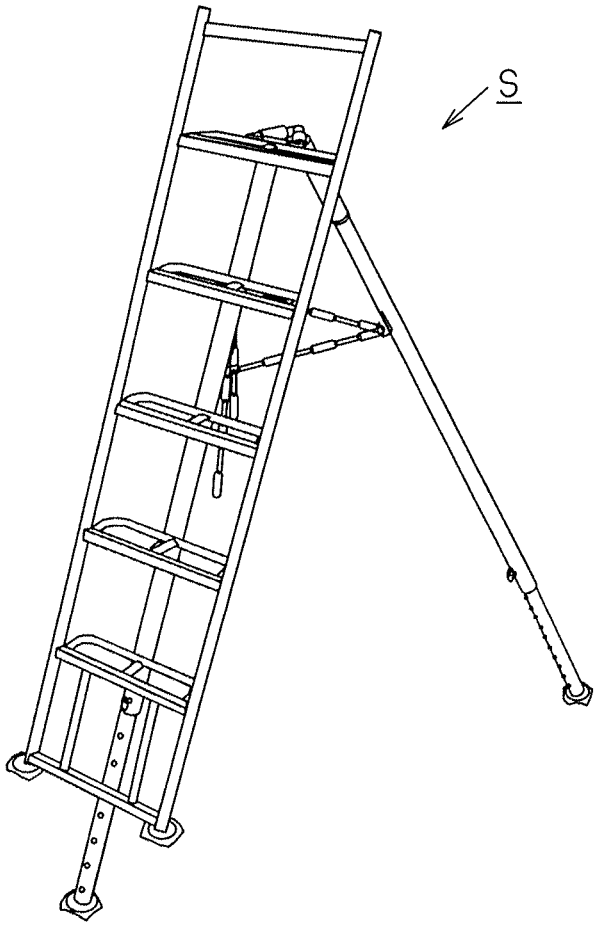
FIG. 15 is an isometric projection view showing the front, top, and right sides of the stepladder of the first embodiment.
Figure 16:
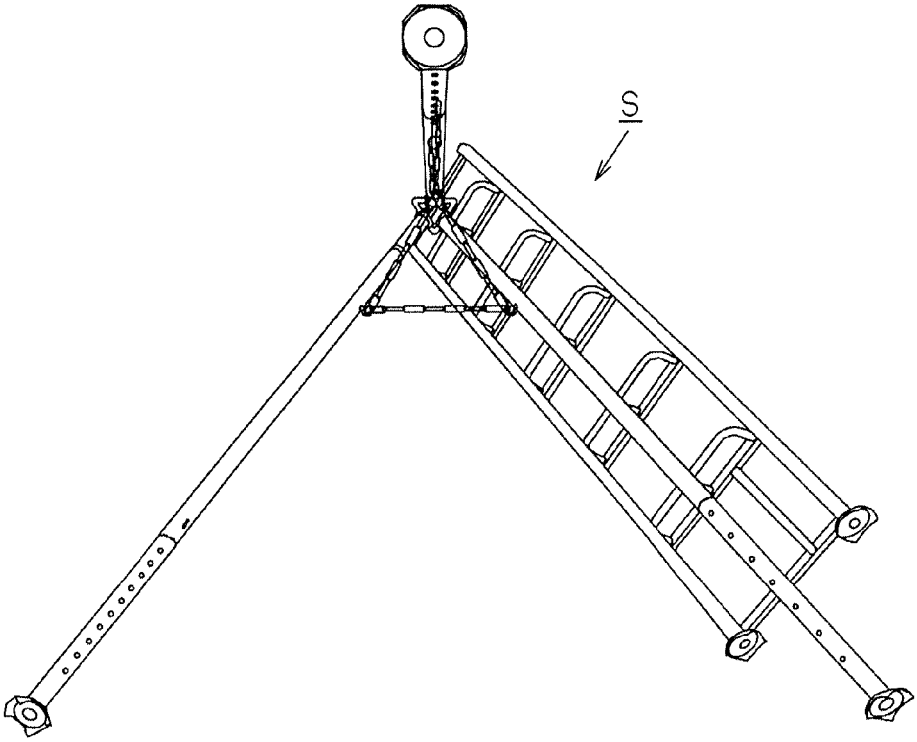
FIG. 16 is an isometric projection view showing the rear, bottom, and left sides of the stepladder of the first embodiment.

(1) As shown in FIGS. 1, 15 and 16, the coupling pipe 32 of the front support PL is coupled to the front shaft 31 of the regular triangular coupling frame Tcp. The coupling pipe 34 of the rear right fixing member Psr is coupled to the right shaft 33. The coupling pipe 36 of the rear left fixing member Psl is coupled to the left shaft 35. Thus, each support is coupled to the coupling frame Tcp to be rotational about the corresponding one of the three shafts of rotation 31, 33 and 35. Accordingly, the three supports are arranged at regulated positions to form a regular triangular pyramid. This allows the stepladder to withstand external force applied from any of the front, rear, right and left directions and maintain uniform balance. This reduces the risk of lateral toppling. In particular, regarding the conventional problem that an increase in the height of the stepladder increases the risk of lateral toppling, the legs of the three supports, which are extended to increase the height of the stepladder, can be easily spread in three directions from the coupling frame with limited restrictions of the installation location. This reduces the risk of toppling.

In addition, each of the three supports is coupled to be rotational about the corresponding one of the three rotation shafts of the coupling frame Tcp. Thus, each of the three supports can individually form any angle with the horizontal installation surface. Reduction in the angles enlarges the installation area. Thus, unlike the conventional stepladders, the risk of toppling can be reduced.

(2) Although including a ladder attached to one of the three supports, the present embodiment is stable. This allows the front support PL with the ladder to be set in small space such as a place where equipment is already installed and a place with hedges.

(3) The rear right support Pudr is attached to the rear right fixing member Psr. The rear left support Pudl is attached to the rear left fixing member Psl. The three supports including the front support with ladder form the stepladder. The right and left supports are removal. Thus, when the stepladder cannot be set with the supports coupled in a place where a facility pipe or a tree branch is located above the ground, the support that prevents the setting is removed and then coupled again at a position beyond the facility pipe or the tree branch. This allows for setting of the stepladder.

(4) The legs of the three supports can extend and contract. This allows the stepladder to be set in various places with steps. Further, the stepladder can be set in places with significant slopes and unevenness by replacing the right and left supports with other shorter or longer supports.

(5) Although including a ladder attached to the support PL of the three supports, the present embodiment is stable. Thus, the front leg of the ladder does not have to include two legs. In addition, the width of the ladder can be reduced, and the rear leg can be free from steps. Thus, compared to a conventional four-legged or tripod stepladder, the overall size and the weight of the stepladder are reduced.

Figure 4A:
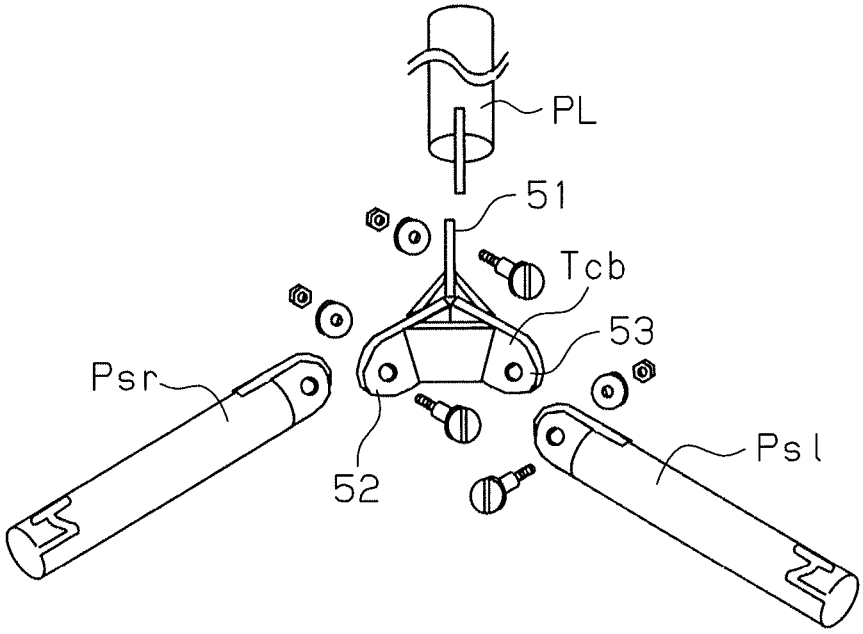
FIG. 4A is an exploded perspective view showing main components of a stepladder of another embodiment.
Figure 4B:
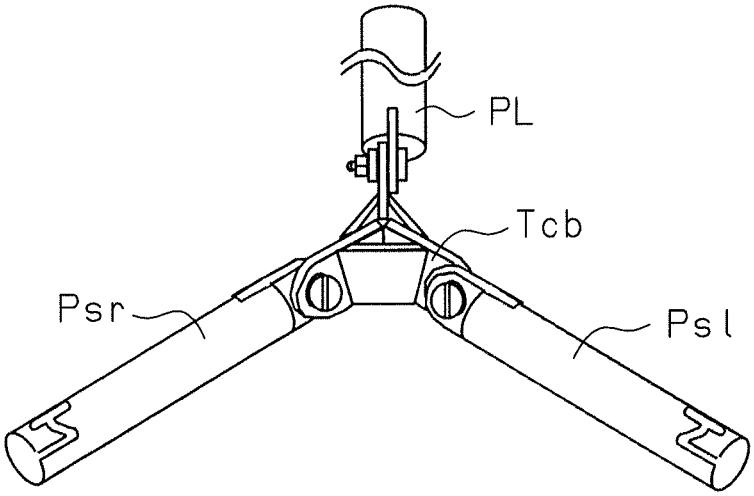
FIG. 4B is a perspective view showing the assembled main components.

FIGS. 4A and 4B are perspective views showing a coupling frame of another embodiment. This coupling frame differs from the first coupling frame Tcp of the first embodiment in the following points. A second coupling frame Tcb has the shape of a regular triangle and includes coupling pieces 51, 52 and 53 that function as coupling sections. The coupling pieces 51, 52 and 53 project from the three vertices located at equal angular intervals.

Three sets of a bolt, washer, and nut couple the front support PL, the rear right fixing member Psr, and the rear left fixing member Psl to the coupling pieces 51, 52 and 53 of the second coupling frame Tcb, respectively. The front support PL is coupled to the second coupling frame Tcb to be rotational about the corresponding bolt, which functions as the shaft of rotation. The fixing members Psr and Psl couples the respective rear right support and the rear left support to the second coupling frame Tcb such that the rear right support and the rear left support rotate about the respective bolts, which function as the shafts of rotation.

The stepladder including the second coupling frame Tcb has the same advantages as the stepladder of the first embodiment.

Figure 10B:
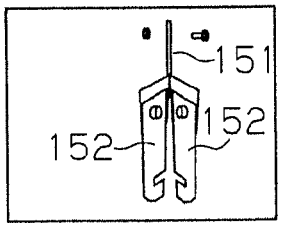
Figure 10A:
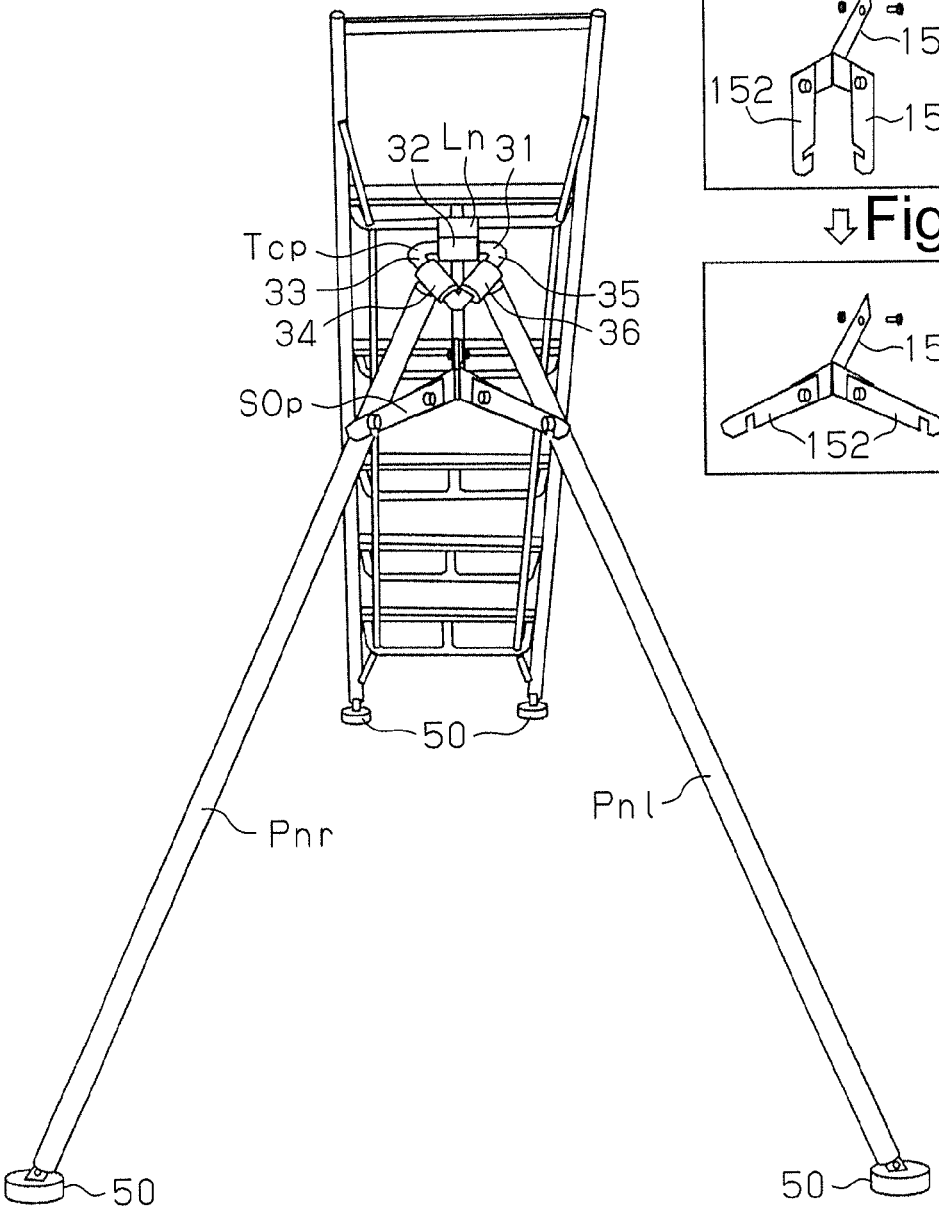
FIG. 10A is a perspective view showing a use position of a stepladder of a second embodiment of the present invention.

FIG. 10A is a perspective view showing a use position of a stepladder of a second embodiment according to the present invention. This embodiment is used only in a place that has a flat surface and is free from installation restrictions. The present embodiment reduces the risk of toppling compared to conventional four-legged or tripod stepladders.

The coupling pipe 32 of a front ladder Ln is coupled to the front shaft 31 of the first coupling frame Tcp. The coupling pipe 34 of a rear right support Pnr is coupled to the right shaft 33. The coupling pipe 36 of the rear left support Pnl is coupled to the left shaft 35. Thus, the three supports are coupled to the first coupling frame Tcp to be rotational about the three sides of the first coupling frame Tcp that function as the shafts of rotation. A slip stopper 50 is attached by a universal joint to each of the legs of the front ladder Ln, the leg of the rear right support Pnr, and leg of the rear left support Pnl.

A spread stopper SOp includes one fixed piece 151 and two movable pieces 152. The spread stopper SOp is suspended from the front ladder Ln with the fixed piece 151 of the spread stopper SOp fixed to the front ladder Ln. The two movable pieces 152 are rotationally coupled to the fixed piece 151. Each movable piece 152 of the spread stopper SOp includes a cut out hole that engages with the hook of the rear right support Pnr or the hook of the rear left support Pnl to limit spreading of the supports. The angle between the horizontal surface and each of the front ladder Ln, the rear right support Pnr, and the rear left support Pnl is maintained at 70 degrees.

Figure 10C:
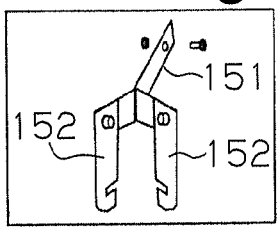
Figure 10D:
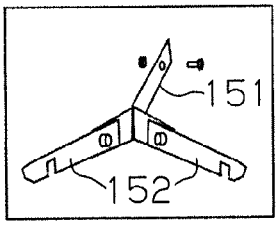
Figure 11:
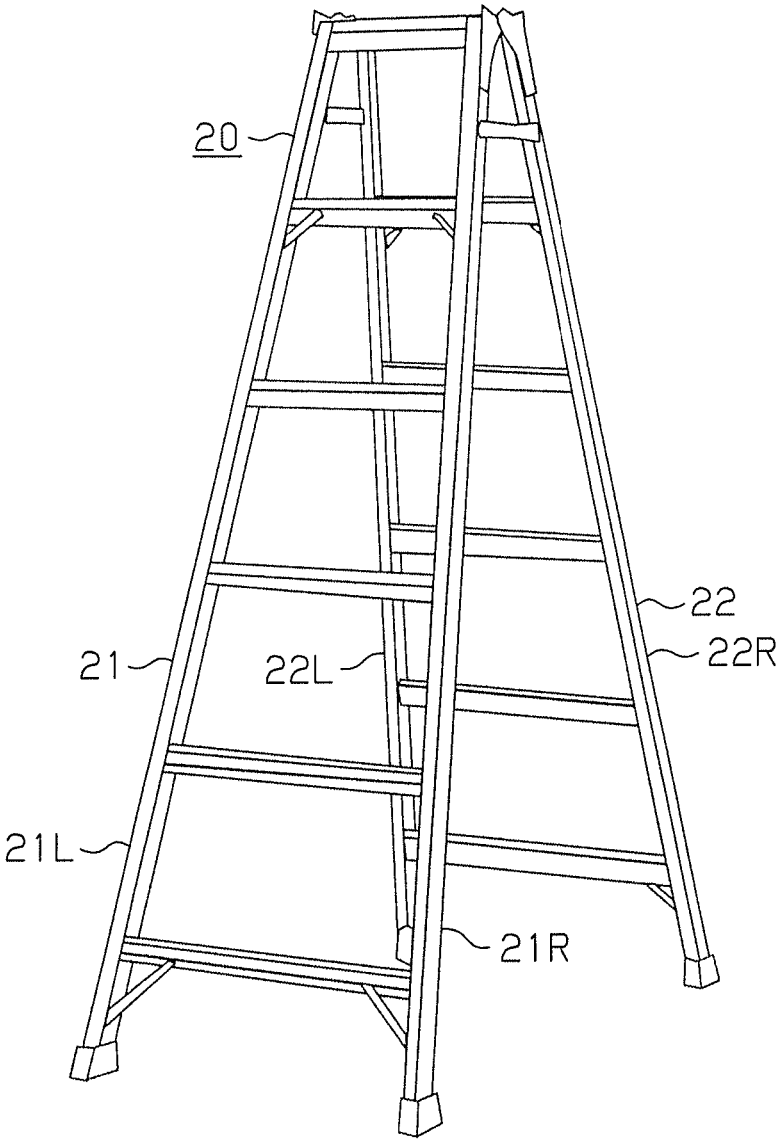
Fig.11(Prior Art)
FIG. 11 is a perspective view showing a four-legged stepladder of the first conventional example.
Figure 12:
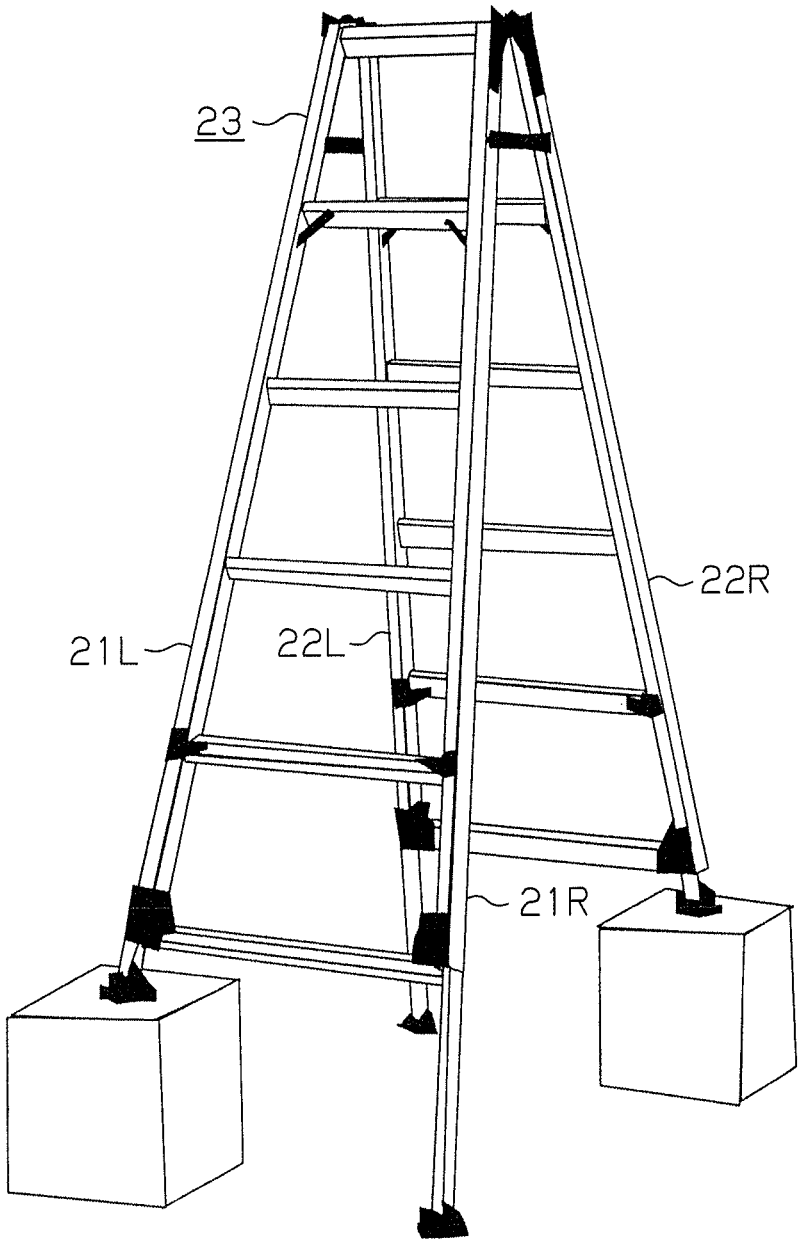
Fig.12(Prior Art)
FIG. 12 is a perspective view showing a four-legged stepladder of the second conventional example.
Figure 13:
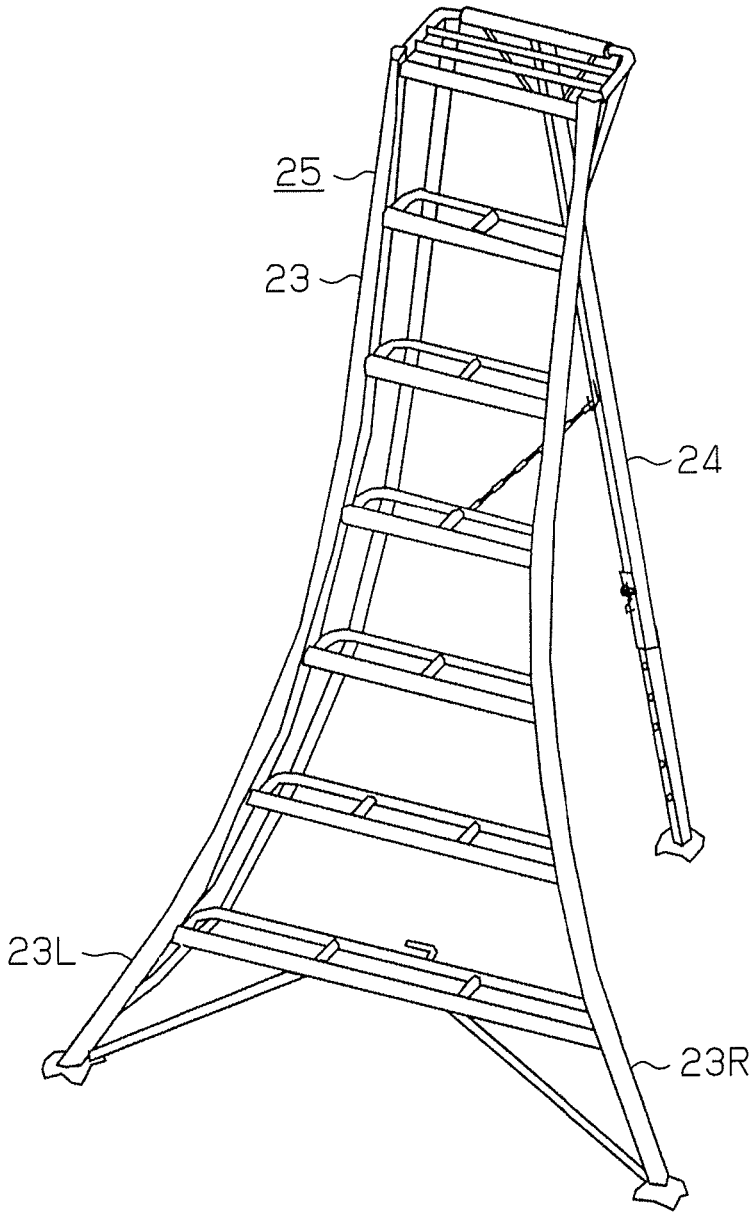
Fig.13(Prior Art)
FIG. 13 is a perspective view showing a garden tripod stepladder of the third conventional example.

FIGS. 10B, 10C and 10D show the assembly sequence of the spread stopper SOp. The spread stopper SOp may include three cut out holes so that the angle between the horizontal installation surface and each support is selectively set to 75 degrees, 70 degrees, and 65 degrees.

Figure 17:
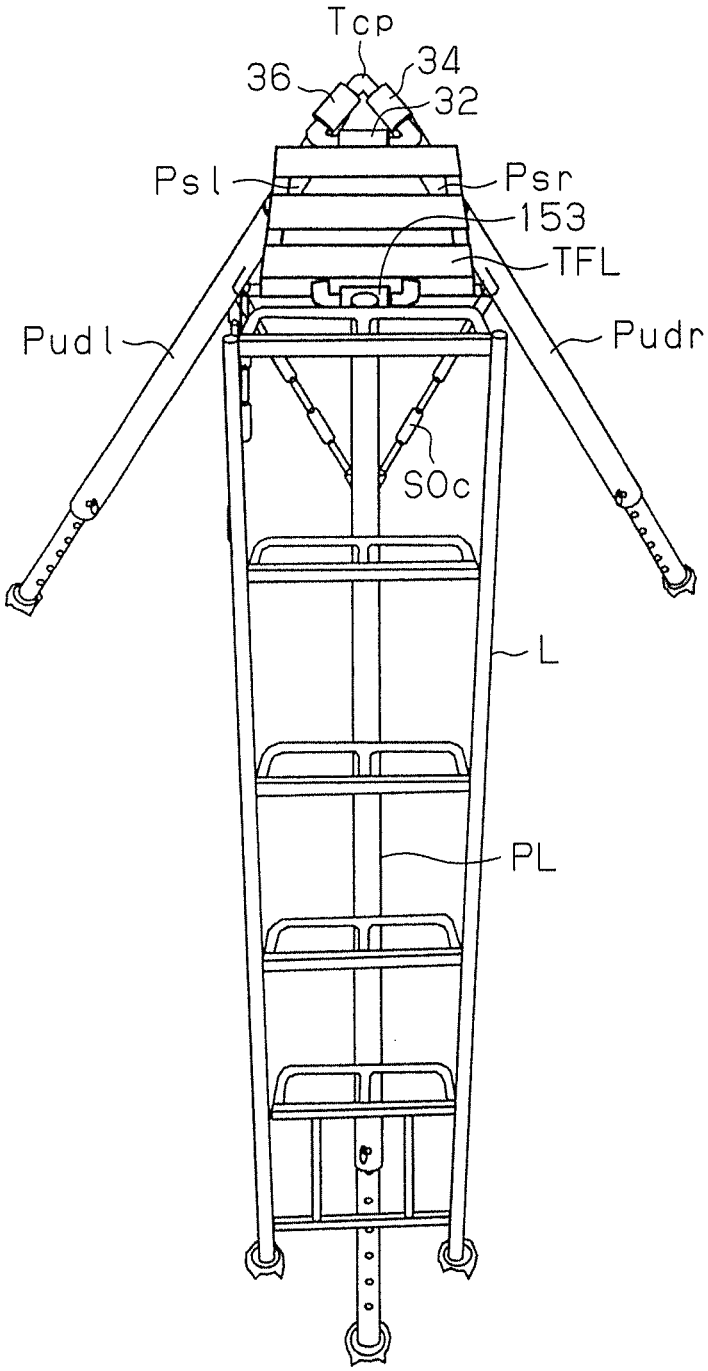
FIG. 17 is a perspective view showing a use position of a stepladder of further embodiment according to the present invention.

FIG. 17 is a perspective view showing a use position of a stepladder of further embodiment according to the present invention. This embodiment differs from the first embodiment shown in FIG. 1 in that a top operation platform TFL is arranged between the first coupling frame Tcp and the front support PL. The top operation platform TFL has a large area that allows an operator to stand on the top operation platform TFL. The top operation platform TFL is rotationally coupled to the coupling frame Tcp by the coupling pipe 32 in the same manner as the first embodiment. In addition, another coupling pipe 153 rotationally couples the top operation platform TFL to the front support PL. Thus, the coupling pipe 153, the top operation platfonn TFL and the coupling pipe 32 rotationally couple the front support PL to the first coupling frame Tcp. The pipes 34 and 36 rotationally couple the rear left support Pudl and the rear right support Pudr, respectively, to the first coupling frame Tcp.

In the stepladder of the further embodiment shown in FIG. 17, the top operation platform TFL is arranged between the first coupling frame Tcp and the front support PL. This allows an operator to stand on the stable top operation platform TFL having a large area. In addition, the stepladder of the present embodiment has the same advantages as the first embodiment shown in FIG. 1.

DESCRIPTION OF THE REFERENCE NUMERALS

S: stepladder, Tcp: first coupling frame, Tcb: second coupling frame, Psr: rear right fixing member, Psl: rear left fixing member, Pl: front support, L: ladder, Pudr: rear right support, Pudl: rear left support, Hr: right cut out groove, Hl: left cut out groove, PP: projection for positioning, Gu: step of support, SOc: first spread stopper, SOp: second spread stopper, Ln: front ladder, Pnr: rear right support, Pnl: rear left support, a: ground contact point of front leg of stepladder S, b: ground contact point of rear right leg of stepladder S, c: ground contact point of rear left leg of stepladder S, d: ground contact point of front left leg of stepladder 25, e: ground contact point of front right leg of stepladder 25, f: ground contact point of rear leg of stepladder 25, g: ground contact point of front left leg of four-legged stepladder 20, h: ground contact point of front right leg of four-legged stepladder 20, i: ground contact point of rear right leg of four-legged stepladder 20, j: ground contact point of rear left leg of four-legged stepladder 20, Cc: center of gravity of operator, TFL: top operation platform

The invention claimed is:

1. A stepladder comprising:

a coupling frame having a front shaft, a right shaft and a left shaft that are connected with each other to form a triangle, the coupling frame being entirely formed from a pipe;

a front support that is coupled to the coupling frame and includes a ladder and a first leg that can extend and contract;

a rear right support that is coupled to the coupling frame by a rear right fixing member and includes a second leg that can extend and contract;

a rear left support that is coupled to the coupling frame by a rear left fixing member and includes a third leg that can extend and contract; and a spread stopper that limits spreading of the front support, the rear right support, and the rear left support, a first coupling pipe of the front support being rotationally coupled to the front shaft of the coupling frame so as to permit said first coupling pipe to rotate about said front shaft, a second coupling pipe of the rear right fixing member being rotationally coupled to the right shaft so as to permit said second coupling pipe to rotate about said right shaft, a third coupling pipe of the rear left fixing member being rotationally coupled to the left shaft so as to permit said third coupling pipe to rotate about said left shaft, wherein the rear left support and the rear right support are attached to the rear left fixing member and the rear right fixing member, respectively, in a removable manner, including the front support, the rear left support, and the rear right support form the stepladder, and the spread stopper couples all said supports together so that the three supports are arranged to form a triangular pyramid and displacement of the three supports in three directions including a front direction, a rear right direction, and a rear left direction is restricted.

2. The stepladder according to claim 1, wherein the rear left fixing member includes a hollow pipe body that opens at a lower end thereof, the rear right fixing member includes a hollow pipe body that opens at a lower end thereof, a lower portion of the pipe body of each fixing member includes a cut out groove, a distal end section that extends upward from a body section of each support has a reduced outer diameter over a length that is inserted into the pipe body of a corresponding one of the fixing members, so that each support includes a step formed between the distal end section and the body section, a tip section of each support is tapered, the distal end section of each support includes a projection for positioning, the cut out groove of each fixing member has a width that is greater than an outer diameter of the projection, each cut out groove includes:

a first linear section that extends upward from a cut end at an inner side of the lower portion of the pipe body of each fixing member and is parallel with an axis of the fixing member;

an inclined section extending outward and diagonally downward from an uppermost position of the first linear section; and a second linear section that extends upward and downward from a lowermost position of the inclined section and is parallel with the axis of the fixing member, and when each support is inserted and coupled to the pipe body of a corresponding one of the fixing members, the projection is aligned with the cut end of the cut out groove after the distal end section of the support is inserted, the projection and the support are moved upward along the first linear section of the cut out groove, the projection and the support are moved downward along the inclined section from a position where the upward movement ends, the projection and the support are moved upward along the second linear section from a position where the downward movement ends, and coupling of the support to the fixing member completes when the upward movement ends, when the coupling of each support completes, the lower portion of the pipe body of the fixing member is in contact with the step of the support, and a shape of the cut out groove of the lower portion of the pipe body of the rear right fixing member and a shape of the cut out groove of the rear left fixing member are symmetrical.

3. The stepladder according to claim 1, wherein a top operation platform is arranged between the coupling frame and the front support, and the top operation platform is rotationally coupled to the coupling frame by a pipe and rotationally coupled to the front support by another pipe.

* * * * *